US006640866B2

(12) United States Patent
Kerr et al.

(10) Patent No.: US 6,640,866 B2
(45) Date of Patent: Nov. 4, 2003

(54) LAMINATOR ASSEMBLY HAVING AN IMPROVED DUAL DUROMETOR LAMINATION ROLLER

(75) Inventors: Roger S. Kerr, Brockport, NY (US); Martin L. Slade, Hemlock, NY (US)

(73) Assignee: Eastman Kodak Company, Rochester, NY (US)

( * ) Notice: Subject to any disclaimer, the term of this patent is extended or adjusted under 35 U.S.C. 154(b) by 131 days.

(21) Appl. No.: 09/953,778

(22) Filed: Sep. 17, 2001

(65) Prior Publication Data

US 2003/0052929 A1 Mar. 20, 2003

(51) Int. Cl.[7] ..... B30B 3/00

(52) U.S. Cl. ..... 156/555; 156/308.2; 156/582; 156/583.1; 492/56

(58) Field of Search ..... 156/555, 580, 156/582, 583.1, 308.2; 492/28, 46, 48, 49, 53, 56

(56) References Cited

U.S. PATENT DOCUMENTS 5,203,942 A 4/1993 DeCook et al.
5,268,708 A 12/1993 Harshbarger et al.
5,777,650 A * 7/1998 Blank ..... 347/103
5,860,360 A * 1/1999 Lane, III et al. ..... 101/376
5,887,517 A * 3/1999 Liang et al. ..... 100/327
5,983,799 A * 11/1999 Lane, III et al. ..... 101/375
6,435,246 B1 * 8/2002 Kerr ..... 156/553
6,463,981 B1 * 10/2002 Kerr ..... 156/555

OTHER PUBLICATIONS

Kerr, "Laminator Assembly Having a Pressure Roller with a Deformable Layer", U.S. patent application Ser. No. 09/676,877, filed Sep. 29, 2000.

* cited by examiner

*Primary Examiner*—James Sells
(74) *Attorney, Agent, or Firm*—Nelson Adrian Blish

(57) ABSTRACT

A laminating method of forming a pre-press proof (200) which comprises the steps of forming a lamination sandwich (210); placing lamination sandwich (210) at the entrance to a laminator (10) such that the lamination sandwich (210) passes through a nip portion (220) formed by a first lamination roller (120) and a second lamination roller (130) and, wherein at least one of the first lamination roller (120) or second lamination roller (130) comprises a substantially solid core (330), a first deformable layer (250) having a 60–80 durometer and surrounding the substantially solid core (330), and a second deformable layer (260) having a 20–60 durometer and surrounding the first deformable layer (250).

29 Claims, 6 Drawing Sheets

LAMINATOR ASSEMBLY HAVING AN IMPROVED DUAL DUROMETOR LAMINATION ROLLER

FIELD OF THE INVENTION

The present invention relates in general to pre-press proofing and in particular, to an improved lamination apparatus and lamination roller that utilize pressure and heat to laminate media together.

BACKGROUND OF THE INVENTION

Pre-press proofing is a procedure that is used primarily by the printing industry for creating representative images of printed material. In the printing industry pre-press color proofs are used to check for color balance, control parameters and other important image quality requirements, without the cost and time that is required to actually produce printing plates, set up a printing press and produce an example of a representative image. Pre-press proofing avoids the higher costs and a loss of profits that would ultimately be passed on to the customer.

To create a pre-press proof, an original image is separated into individual color separations or digital files. The original image is scanned and separated into the three subtractive primary colors and black. Typically a color scanner is used to create the color separations or digital files and in some instances, more than four color separations or digital files are used. Although there are several ways used in the printing industry to create a pre-press proof from the color separations or digital files they are generally one of three types. The first method being a color overlay system that employs the representative image on a separate base for each color, which are then overlaid to create a pre-press proof. The second, a single integral sheet process in which the separate colors for the representative image is transferred one at a time by lamination onto a single base. The third, a digital method in which the representative image is produced directly onto a receiver stock, or onto an intermediate sheet then transferred by lamination onto a receiver stock from digital files.

The representative image to be laminated can be created on, but is not limited to, a commercially available Kodak image processing apparatus, depicted in commonly assigned U.S. Pat. No. 5,268,708, which describes an image processing apparatus having half-tone color imaging capabilities. The image processing apparatus is arranged to form a representative image onto a sheet of thermal print media in which colorant from a sheet of colorant donor material is transferred to the thermal print media, by applying thermal energy to the colorant donor sheet material to form the representative image. The image processing apparatus is comprised generally of a material supply assembly and a lathe bed scanning subsystem. The scanning subsystem includes: a lathe bed scanning frame, translation drive, translation stage member, printhead, imaging drum, and media exit transports.

The operation of the image processing apparatus comprises of metering a length of the thermal print media from the material supply assembly. The thermal print media is then measured and cut into sheet form of the required length and transported to the imaging drum, registered, wrapped around, and secured onto the imaging drum. Next, a length of colorant donor material is metered out of the material supply assembly, measured, and cut into sheet form of the required length. It is then transported to the imaging drum and wrapped around the imaging drum utilizing a load roller which is described in detail, in commonly assigned U.S. Pat. No. 5,268,708, such that it is superposed in the desired registration with respect to the thermal print media, which has already been secured to the imaging drum.

After the colorant donor sheet material is secured to the periphery of the imaging drum the scanning subsystem or write engine provides the imaging function. This image function is accomplished by retaining the thermal print media and the colorant donor sheet material on the imaging drum while it is rotated past the printhead. The translation drive traverses the printhead and translation stage member axially along the axis of the imaging drum, in coordinated motion with the rotating imaging drum. These movements combine to produce the representative image on the thermal print media.

Once the representative image has been formed on the thermal print media, the colorant donor sheet material is then removed from the imaging drum. This is accomplished without disturbing the thermal print media that is beneath it. The colorant donor sheet material is then transported out of the image processing apparatus by means of the material exit transport. Additional colorant donor sheet materials featuring other desired colorants are sequentially superimposed with the thermal print media on the imaging drum and then imaged onto the thermal print media as previously mentioned, until the representative image is completed on the thermal print media. The representative image formed thereon is then unloaded from the imaging drum and transported by the receiver sheet material exit transport to an exit tray in the exterior of the image processing apparatus.

After a representative image has been formed on the thermal print media, it is transferred to a receiver stock such that the pre-press proof is representative of the image that will be printed by the printing press. A laminator as described in U.S. Pat. No. 5,478,434 can be used to bond or laminate the representative image as a part of a pre-press proofing system. As additional references, U.S. Pat. No. 5,203,942 describes a laminator that employs a lamination/de-lamination system as applied to a drum laminator and pending U.S. patent application Ser. No. 09/676,877, filed Sep. 29, 2000, U.S. Pat. No. 6,463,981 describes a laminator that employs a first lamination roller and a second lamination roller along with endless belts incorporated into a lamination apparatus. For the purpose of this patent application the laminator described in U.S. patent application Ser. No. 09/676,877 U.S. Pat. No. 6,463,981 will be used. It should be noted that the present invention described in this disclosure is not limited to the laminator referenced above.

The receiver stock can be sheet-fed press printing stock, specially coated paper stock, or previously laminated stock. In this latter case a sheet of pre-laminate, which has a pre-laminate support layer consisting of a suitable base material, optionally coated with a releasing material, and a thermal print layer, is placed on top of a receiver sheet, which is also called receiver stock in the industry. The multiple layers form a lamination sandwich, which is fed into the laminator. Once the lamination sandwich exits the laminator the pre-laminate support layer is peeled away from the now pre-laminated receiver stock. Any of the laminators referred to above can be used to affect the transfer of the pre-laminate receiving layer to the receiver stock.

The above described lamination method works well for most materials and both laser thermal and inkjet pre-press proofs. The upper and lower lamination rollers used in the apparatus described above, however, have a less than desirable failure rate in the form of de-lamination of a deformable layer surrounding a substantially solid core due to the high pressure and temperature requirements during the lamination process. Thus, there exists a need to improve lamination roller life.

SUMMARY OF THE INVENTION

The present invention provides, but is not limited to, an improved lamination roller for use in a lamination apparatus used to laminate material to form a pre-press proof used in the graphics industry.

According to one aspect of the present invention a laminator assembly comprises a first lamination roller located on a first side of a media passage; a second lamination roller located on a second side of said media passage so as to oppose said first lamination roller, wherein a nip portion is defined between the first lamination roller and the second lamination roller so as to apply pressure and heat to the media in the media passage which passes through the nip portion. At least one of the first lamination roller and second lamination roller is a lamination roller comprising a substantially solid core which may be solid preferably made of metal. Surrounding the substantially solid core is a first deformable layer having a 60–80 durometer preferably made of a silicone. Surrounding the first deformable layer is a second deformable layer having a 20–60 durometer preferably a silicone-based material.

According to one embodiment, one or more of the rollers can be heated or adapted to accept a heating element while a cross head extrusion method is preferred to form the first and second layers. Other methods well known in the art such casting, molding, shave wrap, or combinations thereof can be used. Typically a bond layer or adhesive layer exists between the substantially solid core and the first deformable layer also between the first and second deformable layer. In the preferred method there would be no bond layer or adhesive layer between the deformable layers. It should be noted that more than two deformable layers could be used depending on the application.

The present invention provides for a lamination roller that increase the life of the lamination roller or rollers due to the heat and stresses of the application, and can be used in laminators or any number of devices, including copiers and fax machines.

According to a feature of the present invention, a laminating system for bonding an image, to a receiver stock, a thermal print media of the type including a carrier and a material to be applied to the receiver stock, having a pair of lamination rollers with at least one of the lamination roller having been improved by having at least two deformable layers. Through these lamination rollers, media or a lamination sandwich of thermal print media and receiver stock can be fed. Having a high durometer of about 60–80 silicone material as the first deformable layer and the second deformable layer having a lower durometer of about 20–60 improves roller life greatly. The low durometer second layer allows for a larger nip while the high durometer first deformable layer increases the bond strength to the substantially solid layer and increasing the strength of the material at the area of highest stress.

The present invention relates to a drive roller assembly for conveying media, which is comprised of opposing lamination rollers. The lamination rollers of this assembly, which optionally can comprise a heater element, comprised of a substantially solid core, a first de-formable layer which surrounds the substantially solid core, a second de-formable layer which surrounds the first de-formable layer and forms an outer surface of one of the first and second opposing rollers or both.

The invention, and its objects and advantages, will become more apparent in the detailed description of the preferred embodiments presented below.

DETAILED DESCRIPTION OF THE INVENTION

The present invention will be directed, in particular, to elements forming part of, or cooperating more directly with an apparatus in accordance with the present invention. It is to be understood that elements not specifically shown or described may take various forms well known to those skilled in the art. For the sake of discussion, but not limitation, the preferred embodiment of the present invention will be illustrated in relation to a laminating apparatus for making pre-press proofs.

Figure 1:
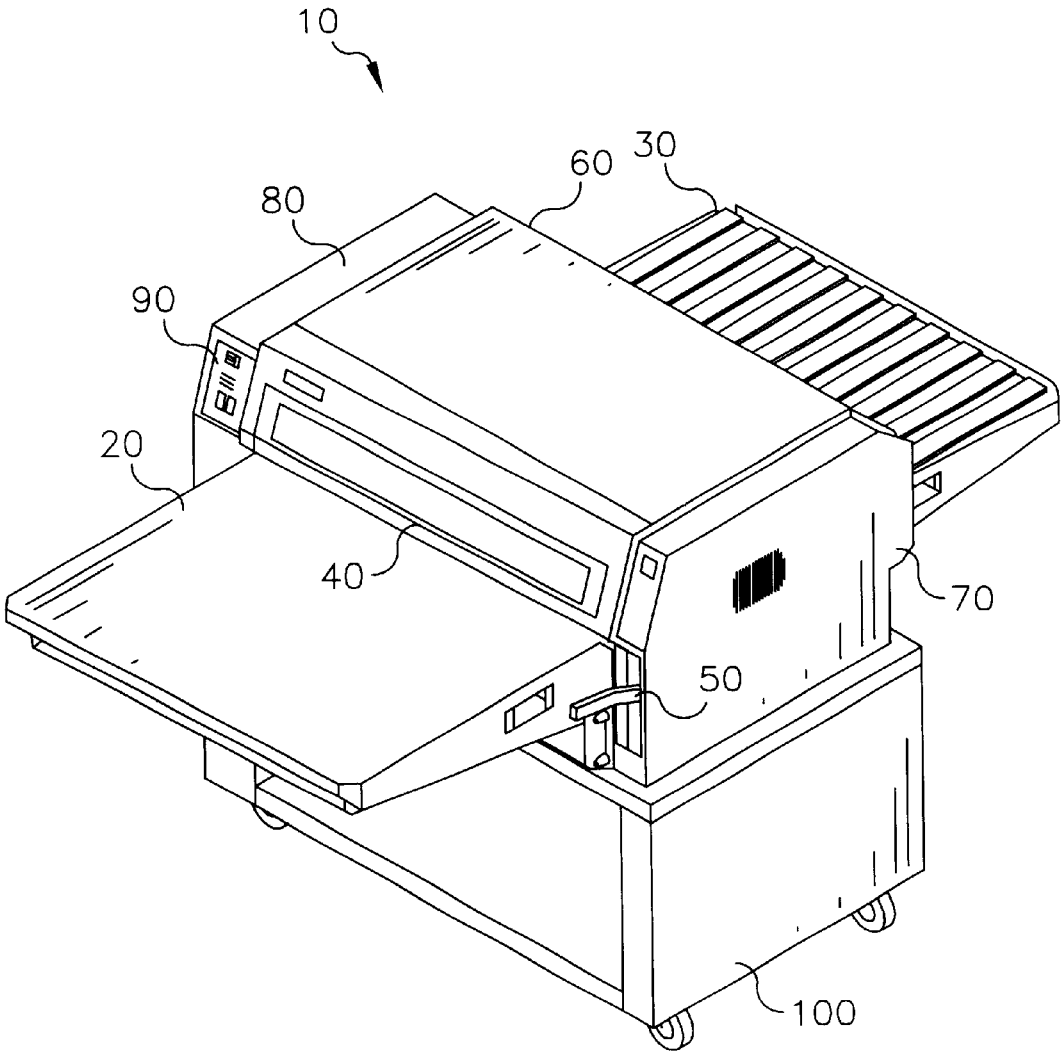
FIG. 1 is a perspective view showing a laminator known in the related art used with the present invention.

Referring now to the drawings wherein like reference numerals represent identical or corresponding parts throughout the several views. Referring to FIG. 1, there is shown perspective view of laminator 10 as described in U.S. patent application Ser. No. 09/676,877. U.S. Pat. No. 6,463,981 The laminator 10 has an entrance table 20, exit table 30, entrance slot 40, pressure lever 50, top cover 60, right side cover 70, left side cover 80, control panel 90, and lamination base 100.

Figure 2:
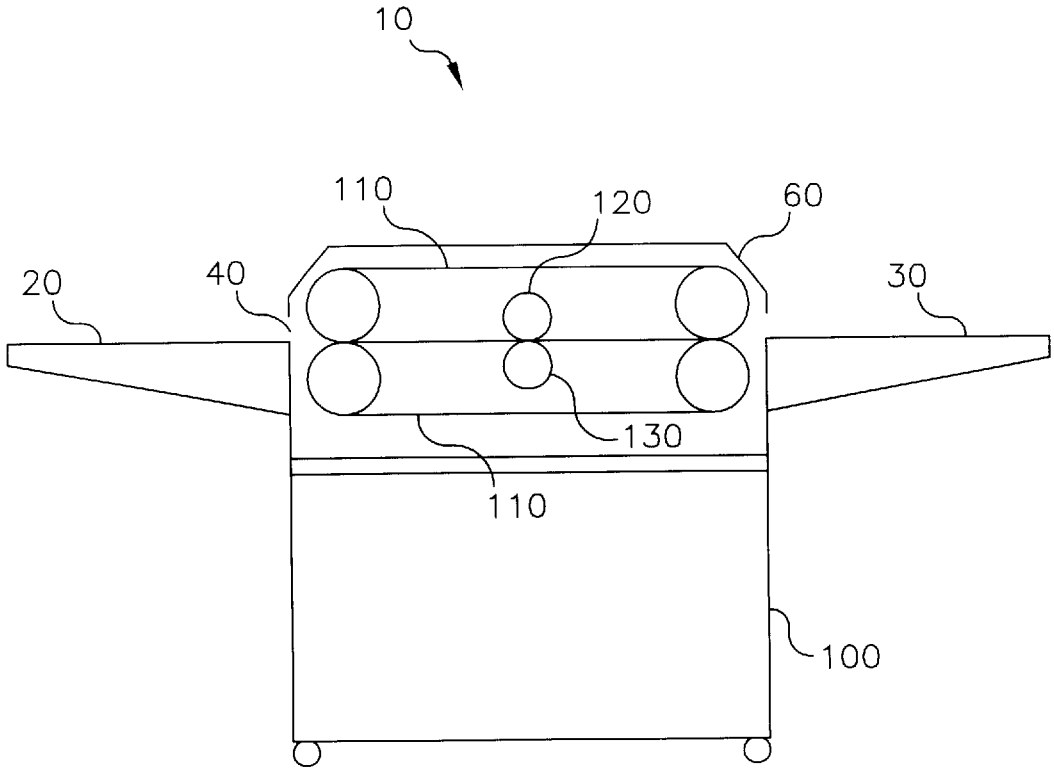
FIG. 2 is a schematic right side elevation of the laminator of FIG. 1.

FIG. 2 is a schematic right side elevation of the laminator of FIG. 1 showing endless belts 110 with first lamination roller 120 and second lamination roller 130 which convey the media to be laminated through the laminator 10. Media to be bonded or laminated passes between the endless belts 110. First lamination roller 120 and second lamination roller 130 provide heat and pressure to laminate the desired media together. This configuration with first lamination roller 120 and second lamination roller 130 is called a "straight-through" laminator. Although the illustrated embodiments show both the first lamination roller 120 and second lamination roller 130 as heated pressure rollers, it also should be recognized that only one of the first lamination roller 120 and second lamination roller 130 could be heated. It is further recognized that both first lamination roller 120 and second lamination roller 130 do not have to be heated for cold lamination applications.

Figure 3:
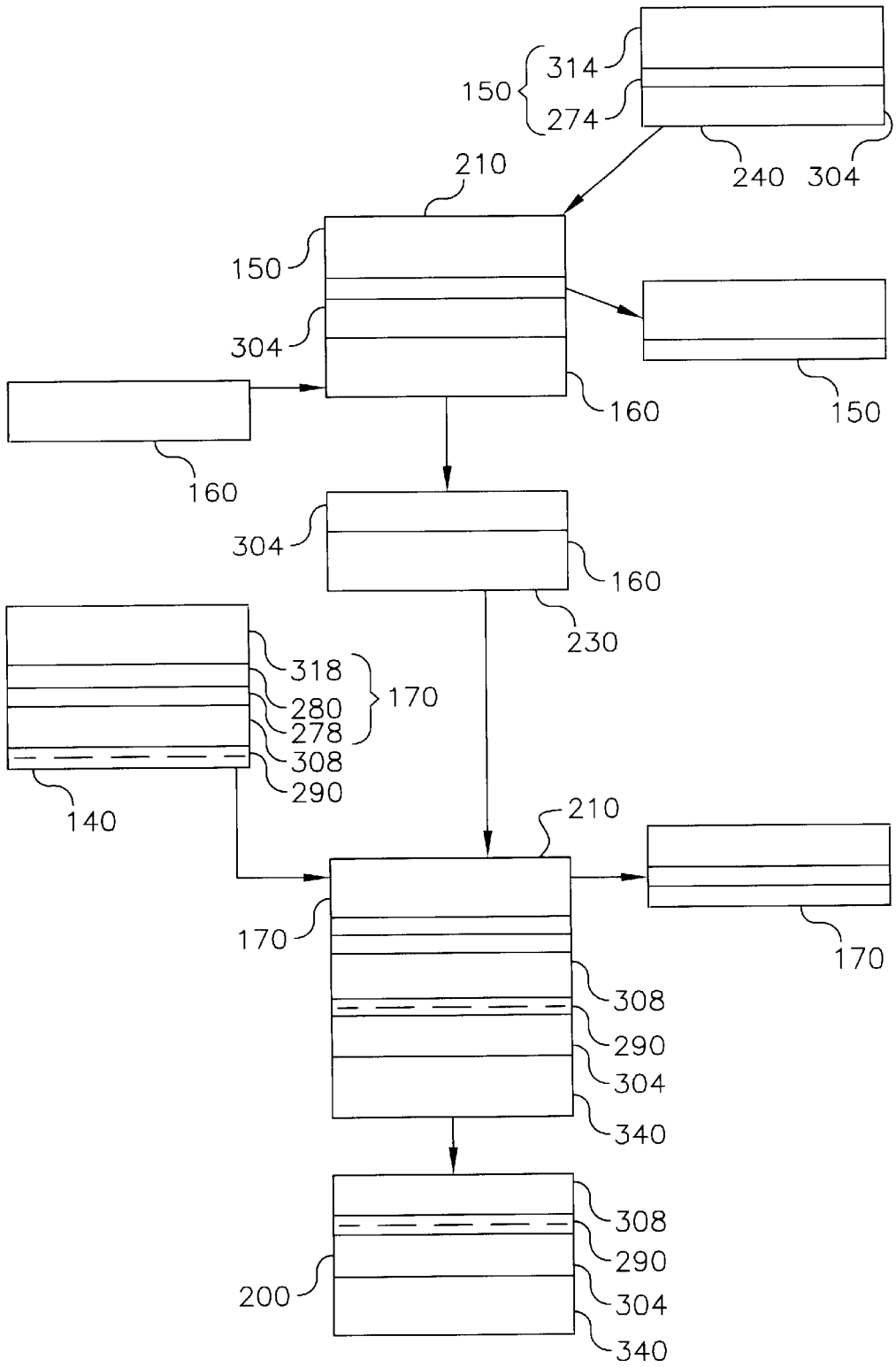
FIG. 3 is a block diagram showing one method for producing a pre-press proof.

Referring to FIG. 3 a block diagram is shown outlining a method for laminating a pre-press proof 200 which comprises the steps of laminating a pre-laminate sheet 240 consisting of a first thermoplastic layer 304, and first support layer 150 having a first support base 314 and a first release layer 274. It should be noted that first support layer 150 may be comprised of several layers or a single support base 310 to a sheet of receiver stock 160. Removing the first support layer 150 forming a pre-laminated receiver stock 230. Creating an imaged receiver sheet 140 consisting of a representative image 290 formed on a second thermoplastic layer 308 and a second support layer 170 having a second support base 318, aluminized layer, and second release layer 278. It should be noted that second support layer 170 may be comprised of several layers or a single support base 310. Laminating the imaged receiver sheet 140 to the pre-laminated receiver stock 230 thereby encapsulating the representative image 290 between the first thermoplastic layer 304 and second thermoplastic layer 308 forming lamination sandwich 210 and removing the second support layer 170 forming a pre-press proof 200.

Figure 4:
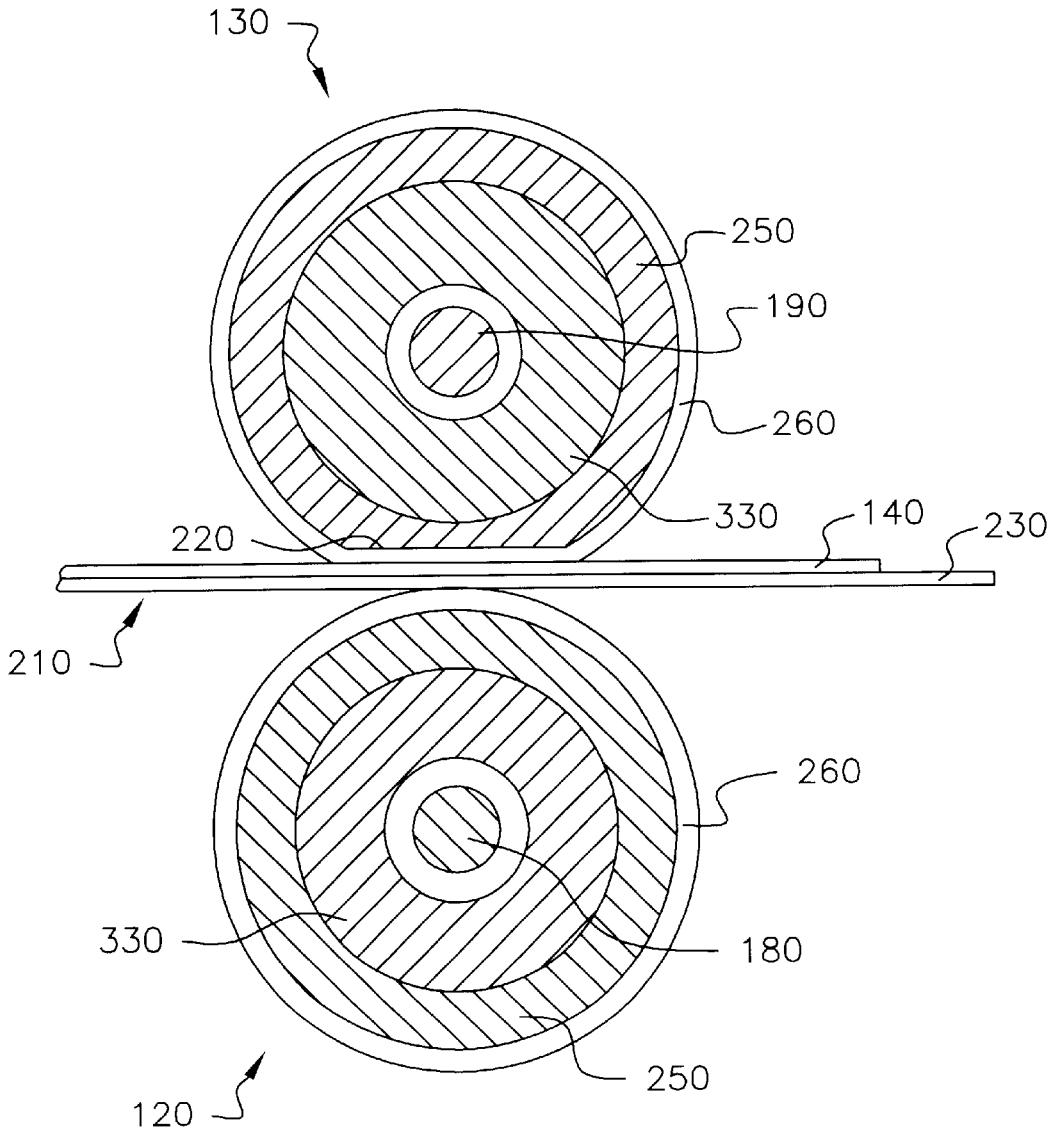
FIGS. 4–6 are section views showing alternative details of the first and second lamination rollers according to the present invention.

Referring to FIG. 4 a section view is shown of the first lamination roller 120 and the second lamination roller 130 of the present invention with lamination sandwich 210 disposed between them. In this embodiment, both the first lamination roller 120 and the second lamination roller 130 have identical construction a substantially solid core 330, a first deformable layer 250 and second deformable layer 260. Alternative embodiments of this invention are contemplated wherein the first lamination roller 120 has a different construction from the second lamination roller 130. First heating element 180 and second heating element 190, respectively apply, heat which migrates to the surface of both the first lamination roller 120 and the second lamination roller 130. Only one lamination roller may be heated at a time or both the first lamination roller 120 and the second lamination roller 130 can be heated simultaneous depending on the embodiment of the invention. Both embodiments are considered within the scope of the invention. In the preferred embodiment, pressure is applied to both the first lamination roller 120 and the second lamination roller 130 in a know manner by, for an example, eccentric rollers, pressure levers, or other means well known in the art that are not shown. First lamination roller 120 can be driven such that when the second lamination roller 130, are pressed together, they both rotate.

The first deformable layer 250 and second deformable layer 260 can made from one or a combination of materials, including but not limited to a low durometer rubber, a compressible rubber, a solid rubber silicone, a foam silicone rubber or others materials having similar deformable characteristics, such as urethane. A low durometer rubber usable in the invention is available from the Dow Corning Corporation. The thickness of first deformable layer 250 is between 1 mm to 4 mm. The thickness of the second deformable layer 260 is between 1 mm to 10 mm.

As lamination sandwich 210 passes nip portion 220, the first deformable layer 250 and second deformable layer 260 deform to increase the width of nip portion 220 to form an enlarged nip width for nip portion 220. The arrangement of the present invention permits the width of nip portion 220 to be decreased or increased as needed by between about 5 millimeters to 30 millimeters. Nip portion 220 is substantially uniform as it extends along the rotational axis of the first lamination roller 120 and the second lamination roller 130.

Figure 5:
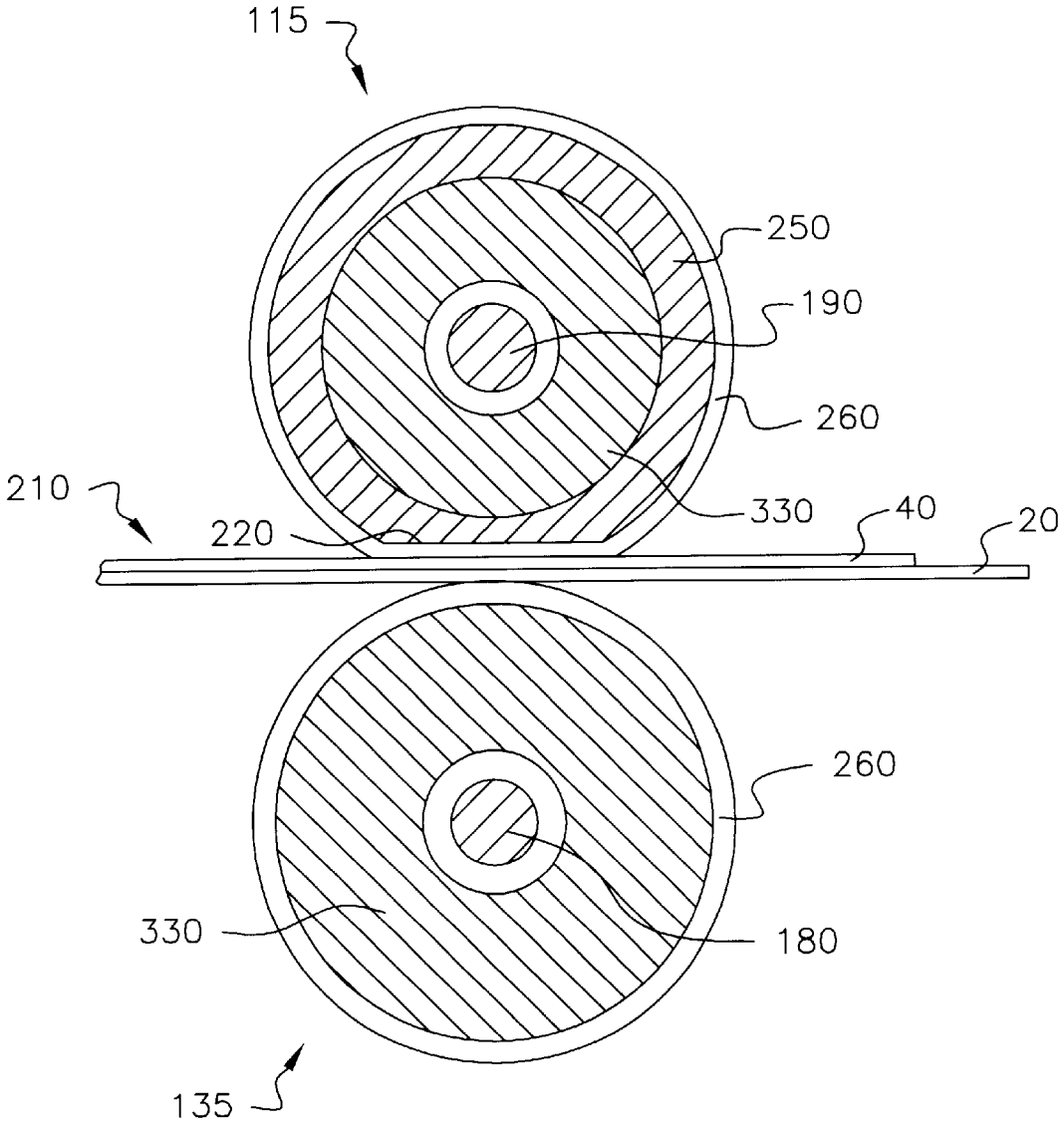

FIG. 5 shows a lamination roller 115 of the present invention having the same construction as the first lamination roller 120 of FIG. 4 with a substantially solid lamination roller 135.

Figure 6:
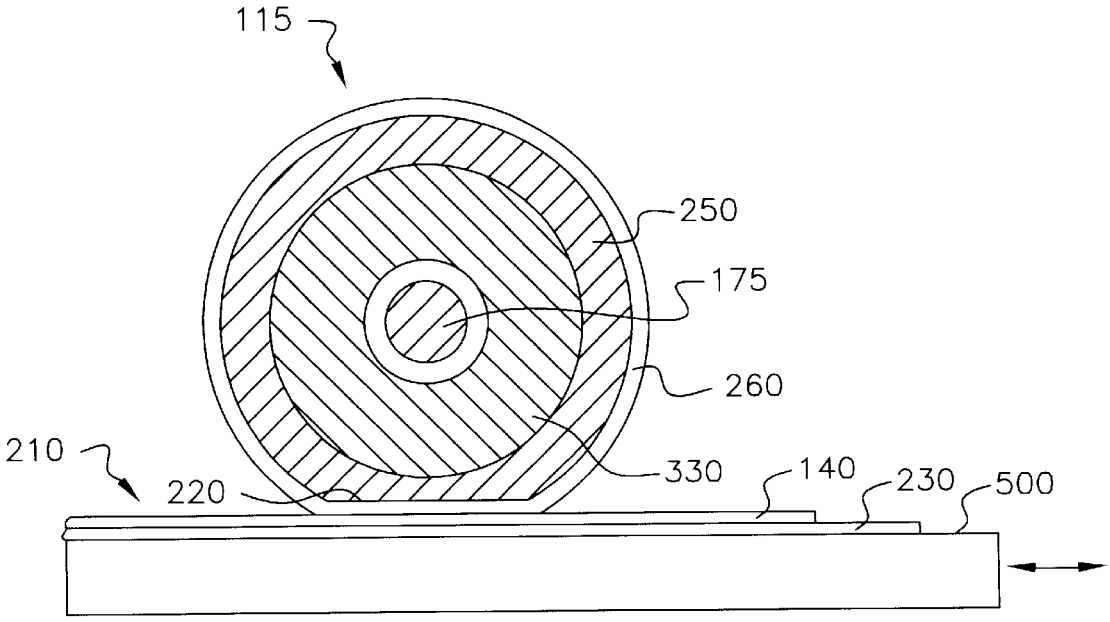

FIG. 6 shows another embodiment in which lamination roller 115 has the same construction as first lamination roller 120 of FIG. 4 having a heating element 175, however, in this embodiment, instead of a second lamination roller 130, a movable platen 500 is shown disposed opposite lamination roller 120, retaining lamination sandwich 210 on the platen 500 as the platen 500 moves under lamination roller 120. Platen 500 additionally causes rotation of lamination roller 120.

Although the illustrated embodiments show both pressure rollers as heated pressure rollers, it is recognized that only one pressure roller may be the heated pressure roller. It is further recognized that both pressure rollers do not have to be heated for cold lamination applications. It is also further recognized that the pressure rollers do not have to be used for lamination applications but as conveying or drive rollers.

The invention has been described in detail with particular reference to certain preferred embodiments thereof, but it will be understood that variations and modifications can be effected within the scope of the invention. For example, the present invention could be used in any field that uses rollers to convey or laminate media.

Parts List

10. Laminator
20. Entrance table
30. Exit table
40. Entrance slot
50. Pressure lever
60. Top cover
70. Right side cover
80. Left side cover
90. Control panel
100. Lamination base
110. Endless belts
115. Lamination roller
120. First lamination roller
130. Second lamination roller
135. Substantially solid lamination roller
140. Imaged receiver sheet
150. First support layer
160. Receiver stock
170. Second support layer
175. Heating element
180. First heating element
190. Second heating element
200. Pre-press proof
210. Lamination sandwich
220. Nip portion
230. Pre-laminated receiver stock
240. Pre-laminate sheet
250. First deformable layer
260. Second deformable layer
274. First release layer
278. Second release layer
290. Representative image
304. First thermoplastic layer
308. Second thermoplastic layer
310. Single support base
314. First support base
318. Second support base
330. Substantially solid core
500. Platen

What is claimed is:

1. A laminator assembly comprising:

a first lamination roller located on a first side of a media passage;

a second lamination roller located on a second side of said media passage and opposing said first roller, wherein a nip portion is defined between said first lamination roller and second lamination roller so as to apply pressure to media in said media passage which passes through said nip portion;

wherein at least one of said first lamination roller and said second lamination roller is a lamination roller comprising a substantially solid core, a first deformable layer having a 60–80 durometer and surrounding said substantially solid core, and a second deformable layer having a 20–60 durometer and surrounding said first deformable layer; and wherein said first deformable layer is bonded to said core.

2. The laminator assembly according to claim 1, wherein said substantially solid core is hollow.

3. The laminator assembly according to claim 1, wherein said substantially solid core surrounds a heater element.

4. The laminator assembly according to claim 3, wherein said substantially solid core is a material selected from a group comprising: metal, a thermally conductive material, or combinations thereof.

5. The laminator assembly according to claim 1, wherein said first deformable layer is a material selected from a group comprising: a high durometer rubber, a compressible rubber, a solid rubber silicone, a foam silicone rubber, or a urethane.

6. The laminator assembly according to claim 1, wherein said second deformable layer is a material selected from a group comprising: a low durometer rubber, a compressible rubber, a solid rubber silicone, a foam silicone rubber, or a urethane.

7. The laminator assembly of claim 1, wherein said substantially solid core is solid.

8. The laminator assembly of claim 1, wherein said second roller consists of a heater element and a substantially solid core surrounding said heater element.

9. The laminator assembly of claim 1, wherein said second roller consists of a heater element, a substantially solid core surrounding said heater element, and a deformable layer surrounding said substantially solid core.

10. The laminator assembly of claim 1, wherein at least one of the first or second rollers is formed by the method of cross head extrusion of the first and second deformable layers.

11. A laminator assembly of claim 10 wherein said first deformable layer is machined prior to application of said second deformable layer.

12. A laminator assembly as in claim 1 wherein said first deformable layer is 1 mm to 4 mm thick.

13. A laminator assembly as in claim 1 wherein said second deformable layer is between 1 mm to 10 mm thick.

14. A laminator assembly comprising:

a moveable platen located on a first side of a media passage;

a roller located on a second side of said media passage opposing said moveable platen, wherein a nip portion is defined between said moveable platen and said roller so as to apply pressure to media in said media passage which passes through said nip portion;

wherein said roller comprises a substantially solid core, a first deformable layer having a 60–80 durometer and surrounding said substantially solid core, and a second deformable layer having a 20–60 durometer and surrounding said first deformable layer; and wherein said first deformable layer is bonded to said core.

15. The laminator assembly according to claim 14, wherein said substantially solid core is hollow.

16. The laminator assembly according to claim 14, wherein said substantially solid core comprises a material selected from a group comprising: metal, a thermally conductive material, or combinations thereof.

17. The laminator of claim 14, wherein said roller further comprises a heater element capable of being heated.

18. The laminator assembly according to claim 14, wherein said deformable layer comprises a material selected from a group comprising: a low durometer rubber, a compressible rubber, a solid rubber silicone, a foam silicone rubber, or a urethane.

19. The laminator assembly of claim 14, wherein said substantially solid core is solid.

20. The laminator assembly of claim 14, wherein at least one of said first or second rollers are formed by head extrusion of said first and second deformable layers.

21. A roller comprising:

a substantially solid core, a first deformable layer having a 60–80 durometer and surrounding said substantially solid core, and a second deformable layer having a 20–60 durometer and surrounding said first deformable layer; and wherein said first deformable layer is bonded to said core.

22. A roller according to claim 21, wherein said substantially solid core is hollow.

23. A roller according to claim 21, wherein said substantially solid core comprises a material selected from a group comprising: metal, a thermally conductive material, or combinations thereof.

24. A roller according to claim 21, wherein said substantially solid core is adapted to accept a heating element.

25. A roller according to claim 21, wherein said deformable layer is selected from a group comprising: a low durometer rubber, a compressible rubber, a solid rubber silicone, a urethane, or combinations thereof.

26. A laminating method comprising the steps of:

forming a lamination sandwich;

placing said lamination sandwich at an entrance to a laminator such that said lamination sandwich passes through a nip portion formed by a first roller and a second roller;

wherein at least one of said first and second rollers comprises a substantially solid core, a first deformable layer having a 60–80 durometer and surrounding said substantially solid core, and a second deformable layer having a 20–60 durometer and surrounding said first deformable layer; and wherein said first deformable layer is bonded to said core.

27. A laminating method according to claim 26 wherein adjusting said nip portion to between 5 mm and 30 mm.

28. A laminator assembly improvements therein comprising:

a first lamination roller located on a first side of a media passage;

a second lamination roller located on a second side of said media passage so as to oppose said first roller, wherein a nip portion is defined between said first lamination roller and said second lamination roller so as to apply pressure to media in said media passage which passes through said nip portion;

wherein at least one of said first lamination roller and said second lamination roller is a lamination roller comprising a substantially solid core, a first deformable layer having a 60–80 durometer and surrounding said substantially solid core, and a second deformable layer having a 20–60 durometer and surrounding said first deformable layer; and wherein said first deformable layer is bonded to said core.

29. A laminator assembly comprising:

a first lamination roller located on a first side of a media passage;

a second lamination roller located on a second side of said media passage so as to oppose said first roller, wherein a nip portion is defined between said first lamination roller and second lamination roller so as to apply pressure to media in said media passage which passes through said nip portion;

wherein said first lamination roller is comprised of a substantially solid core, a first deformable layer having a 60–80 durometer and surrounding said substantially solid core, and a second deformable layer having a 20–60 durometer and surrounding said first deformable layer; and wherein said first deformable layer is bonded to said core.

* * * * *